United States Patent [19]

Armbruster

[11] Patent Number: 4,729,147

[45] Date of Patent: Mar. 8, 1988

[54] PET GROOMER AND FLEA ANNIHILATOR

[76] Inventor: Joseph M. Armbruster, 2700 NE. 47th St., Lighthouse Point, Fla. 33064

[21] Appl. No.: 906,534

[22] Filed: Sep. 12, 1986

[51] Int. Cl.[4] ..... A47L 5/36

[52] U.S. Cl. ..... 15/314; 15/323; 15/327 R; 15/352; 15/402

[58] Field of Search ..... 15/314, 327 R, 402, 15/323, 347, 352

[56] References Cited

U.S. PATENT DOCUMENTS

| | | | |
|---|---|---|---|
| 2,276,886 | 3/1942 | Smith | 15/402 |
| 2,648,867 | 8/1953 | Erling | 15/402 X |
| 3,159,862 | 12/1964 | MacFarland | 15/323 |
| 3,597,903 | 8/1971 | Schaaf | 15/327 X |
| 4,279,095 | 7/1981 | Aasen | 15/402 X |
| 4,485,583 | 12/1984 | Planty | 15/402 X |
| 4,630,329 | 12/1986 | Shores | 15/402 X |

FOREIGN PATENT DOCUMENTS

| | | | |
|---|---|---|---|
| 668754 | 8/1963 | Canada | 15/314 |

*Primary Examiner*—Chris K. Moore

*Attorney, Agent, or Firm*—Fleit, Jacobson, Cohn & Price

[57] ABSTRACT

A portable, self-contained pet grooming and flea removing device which includes a vacuum device for grooming, removing loose hair, dirt, dandruff and the like, which are removed through interchangeable grooming devices such as a comb, brush or the like and through a flexible hose into a disposable vacuum cleaner-type bag. In addition, the vacuum hose may be easily and quickly provided with a fitting in the form of a nozzle and the hose associated with a different fitting in the vacuum device so that a flea annihilator in the form of an electric grid is placed in operation by manipulation of a power switch so that by "peeling back" the animal's hair, location of flea infestation is easily made so that the nozzle can be placed immediately over the flea so that it is moved through the hose by vacuum and passed through the electrically charged grid thereby killing the flea which is then deposited into the disposable vacuum cleaner-type bag.

11 Claims, 8 Drawing Figures

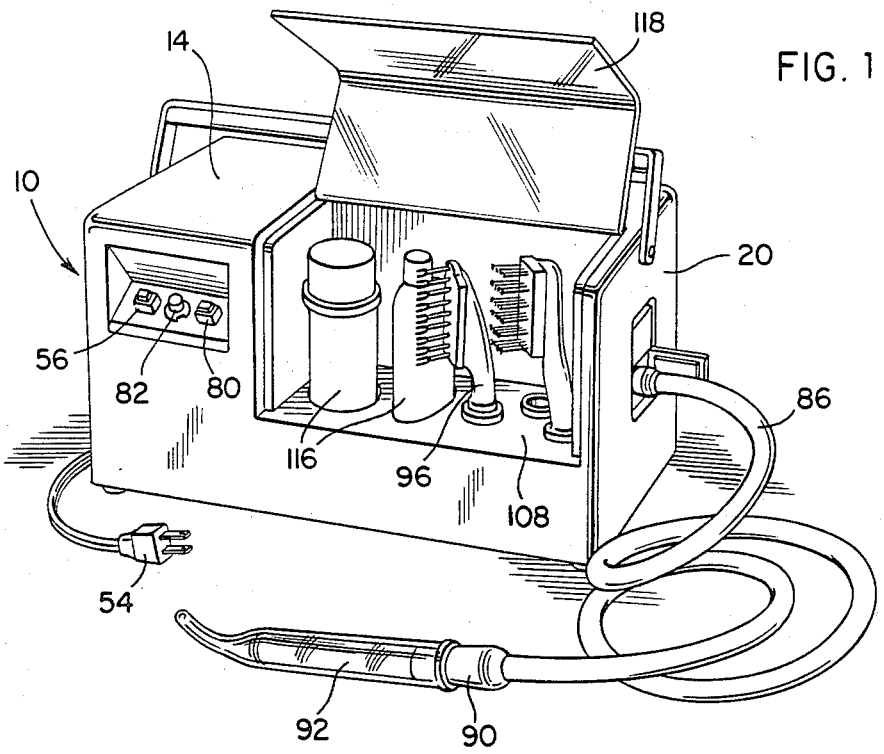
FIG. 1
FIG. 6
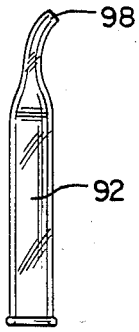
FIG. 7
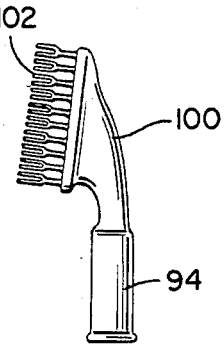
FIG. 2
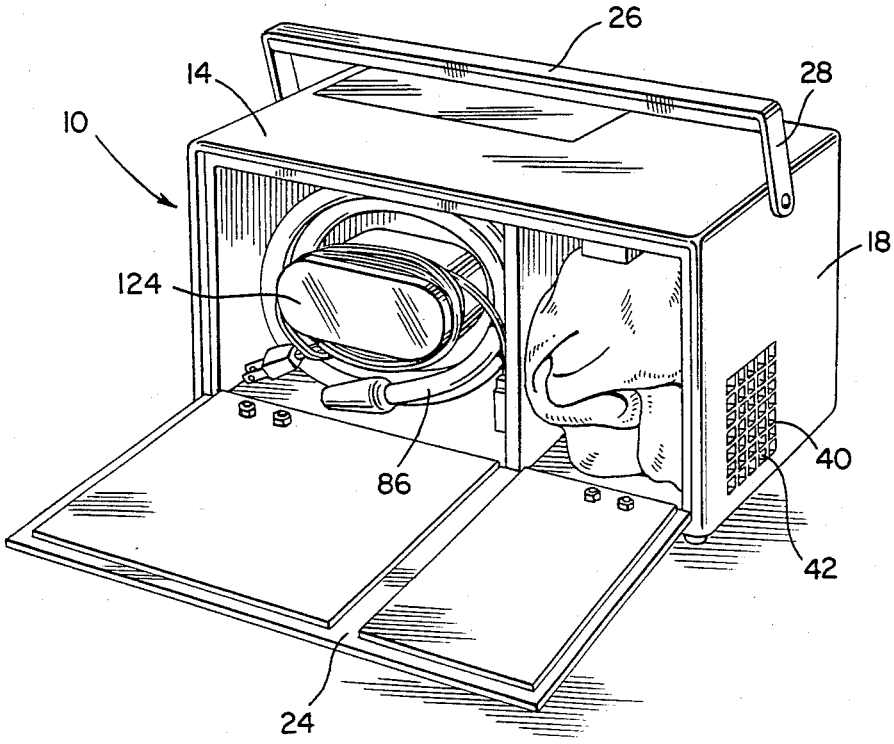
FIG. 8
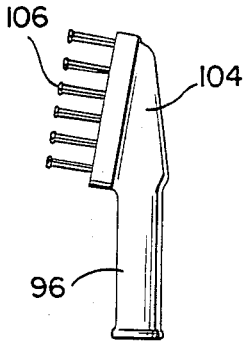

PET GROOMER AND FLEA ANNIHILATOR

BACKGROUND OF THE INVENTION

1. Field of the Invention

The present invention generally relates to a portable, self-contained pet grooming and flea removing device which includes a vacuum device for grooming, removing loose hair, dirt, dandruff and the like, which are removed through interchangeable grooming devices such as a comb, brush or the like and through a flexible hose into a disposable vacuum cleaner-type bag. In addition, the vacuum hose may be easily and quickly provided with a fitting in the form of a nozzle and the hose associated with a different fitting in the vacuum device so that a flea annihilator in the form of an electric grid is placed in operation by manipulation of a power switch so that by "peeling back" the animal's hair, location of flea infestation is easily made so that the nozzle can be placed immediately over the flea so that it is moved through the hose by vacuum and passed through the electrically charged grid thereby killing the flea which is then deposited into the disposable vacuum cleaner-type bag.

2. Information Disclosure Statement

Devices have been provided for grooming animals including combs, brushes and the like and various procedures and techniques have been utilized in order to reduce flea infestation. However, previously known devices and techniques do not utilize a vacuum-type cleaning device having the structural features and functional capabilities of the present invention.

SUMMARY OF THE INVENTION

An object of the present invention is to provide a pet groomer and flea annihilator constructed as a portable, compact, self-contained unit incorporating a vacuum motor/fan unit, a flexible vacuum hose, disposable vacuum cleaner-type bag and interchangeable fittings on the hose for performing various grooming and flea removing procedures.

Another object of the invention is to provide a pet groomer and flea annihilator in accordance with the preceding object in which the vacuum system includes two separate receptacles to which the vacuum hose can be connected with one of the receptacles incorporating an electrically charged grid in the flow path of material passing between the hose and vacuum cleaner-type bag so that a flea removing nozzle may be connected to the free end of the hose for removing fleas so that when they pass inwardly through the grid, they will be electrocuted by coming into contact with the electrically charged grid and deposited in the vacuum cleaner-type bag for easy disposal.

A further object of the invention is to provide a pet groomer and flea annihilator in accordance with the preceding objects having a convenient storage area for the hose and interchangeable nozzles with the unit including a housing with a carrying handle with the housing including control switches, an indicator light and an electrical cord for connection with a conventional electrical circuit with the two fittings of the vacuum system including pivotal closure doors so that the unused vacuum receptacle is closed thereby preventing vacuum leaks.

Yet another object of the present invention is to provide a pet grooming and flea removing device which enables a pet owner to quickly and easily groom a pet even though the pet owner may not have access to an open or outdoor grooming area with the device also enabling flea and flea infestation control which does not require insecticides, sprays, medicaments, or other materials that may affect animals and which may adversely affect the pet owner or others who may be allergic to hair, dandruff and the like as well as insecticides, pesticides and the like which may be used in some instances for flea control.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front perspective view of the pet groomer and flea annihilator of the present invention with a closure door for a storage area being shown in open position.

FIG. 2 is a perspective view of the structure of FIG. 1 illustrating the rear thereof with the access door to the storage area and vacuum cleaning area in open position.

FIGS. 6, 7 and 8 are elevational views of interchangeable appliances connectable to the outer end of the flexible vacuum hose.

DESCRIPTION OF THE PREFERRED EMBODIMENT

Figure 3:
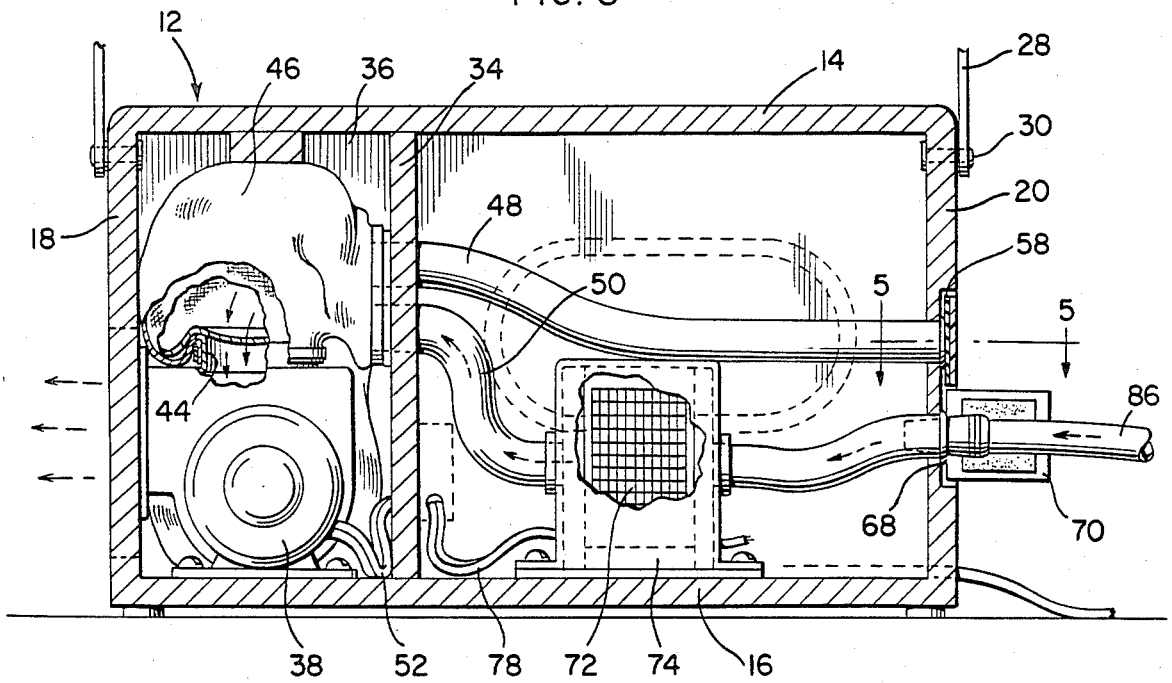
FIG. 3 is a longitudinal, sectional view of the present invention.

Referring now specifically to the drawings, the pet groomer and flea annihilator is generally designated by reference numeral 10 and includes an elongated, generally rectangular parallelepiped housing or casing 12 including a top wall 14, a bottom wall 16, end walls 18 and 20, a front wall 22 and a rear wall 24 which preferably are constructed of high impact plastic material. Supported from the end walls 18 and 20 adjacent the top center thereof is an elongated handle 26 having laterally extending legs 28 attached to the end walls 18 and 20 by a pivot fastener 30. The handle 26 is provided with a rounded inner member 32 to facilitate handling and gripping thereof with the length of the leg or flanges 28 being such that the handle 26 can pivot downwardly into engagement with the top wall 14 or the pivot structures 30 may provide friction to retain the handle in upstanding position for ease of grasping.

The housing 12 includes a transverse partition 34 parallel to the end walls and closer to the end wall 18 than the end wall 20 as illustrated in FIG. 3 to form a vacuum compartment 36 which includes a fan and motor unit 38 having a discharge through an opening 40 in the end wall 18 which is provided with a grill 42 or grid to enable discharge of air. The inlet of the vacuum motor and fan unit, designated by numeral 44, communicates with the chamber 36 which includes a disposable vacuum cleaner bag of paper or similar porous material having an inlet connected through the partition 34 to a pair of vacuum conduits 48 and 50. Insofar as the vacuum unit 38 is concerned and the vacuum cleaner-type bag 46 is concerned, this represents conventional construction employed in vacuum cleaners except that the inlet of the bag 46 is connected to two inlet conduits 48 and 50 rather than a conventionally provided single inlet. As illustrated in FIG. 2, the rear wall 24 is in the form of a pivotal door which can be easily released by conventional fastening devices so that the door may swing to an open position to provide access to the disposable bag 46 for replacement thereof when desired. Thus, insofar as the vacuum unit is concerned and the disposable bag is concerned, they are conventional components with the bag 46 being connected to both of the vacuum inlet conduits 48 and 50. The vacuum unit is electrically powered through an electrical cord 52 which has a male plug 54 on one end thereof with a control switch 56 being provided in the front wall 22 to control operation of the vacuum unit with the control switch 56 being a depressible switch to turn the vacuum unit on or off.

The vacuum inlet conduit 48 extends from the partition 34 to the end wall 20 and is connected to a receptacle 58 in the end wall 20 with the receptacle 58 including a pivotal closure door 60 having a sealing gasket 62 on the inner surface thereof and being pivotally supported in a recess 64 in the end wall 20 by pivot pin 66 so that the door 60 will be maintained closed by the vacuum in the conduit 48 to prevent vacuum leakage. Likewise, the conduit 50 is connected with a receptacle 68 immediately below the receptacle 58 with this receptacle also including a pivotal closure door 70 in the same manner as receptacle 58. Incorporated into the vacuum inlet conduit 50 is an electrically charged wire grid 72 contained in a housing 74 secured to the bottom wall 16 as by fasteners 76 extending through a flange with the housing 74 being hollow and incorporated into the conduit 50 so that all material flowing through the conduit 50 will pass through the housing 74 and thus through and over the grid 72. The grid 72 is electrically connected to the source of electrical energy through conductor 78 and a pushbutton switch 80 and an indicator light 82 is provided to indicate actuation of the electrically charged grid 72. As illustrated in FIG. 1, the switches 56 and 80 and the indicator light 82 are mounted in an inwardly extending recess 84 formed in the front wall 22 forming the front of the vacuum chamber 36.

The flexible vacuum hose of plastic or the like designated by numeral 86 is connected to one of the receptacles 58 or 68 with the hose 86 including a tapered adapter 88 on its inner end and a tapered adapter 90 on its outer end with the adapter 88 telescopically received in one of the receptacles 58 or 68 for communicating the hose 86 with either the vacuum inlet line 48 where material goes directly into the disposable bag 46 or the hose 86 is communicated with the housing 74 so that material passing through the hose will pass through and over the grid 72 and then into the vacuum cleaner-type bag 46. The adapter 90 is telescopically and frictionally received in one of three interchangeable appliances 92, 94 and 96 each of which includes a cylindrical tubular portion that telescopically receives the tapered adapter 90. The adapters 88 and 90 are identical so that it does not make any difference which end of the hose 86 is inserted into a receptacle and which end is provided with the appliance.

The appliance 92 is in the form of a tubular member having a reduced nozzle end 98 that is slightly curved as illustrated in FIG. 6 and is primarily used in removing fleas or flea infestations. The appliance 94 includes a hollow brush head 100 with stiff bristles in the form of plastic elements 102 being provided thereon for use as a brush so that air flowing through and between the bristles 102 will entrain dandruff, loose hair and the like. The appliance 96 includes a similar hollow brush head 104 having a plurality of projecting tines or teeth 106 forming a comb.

Figure 4:
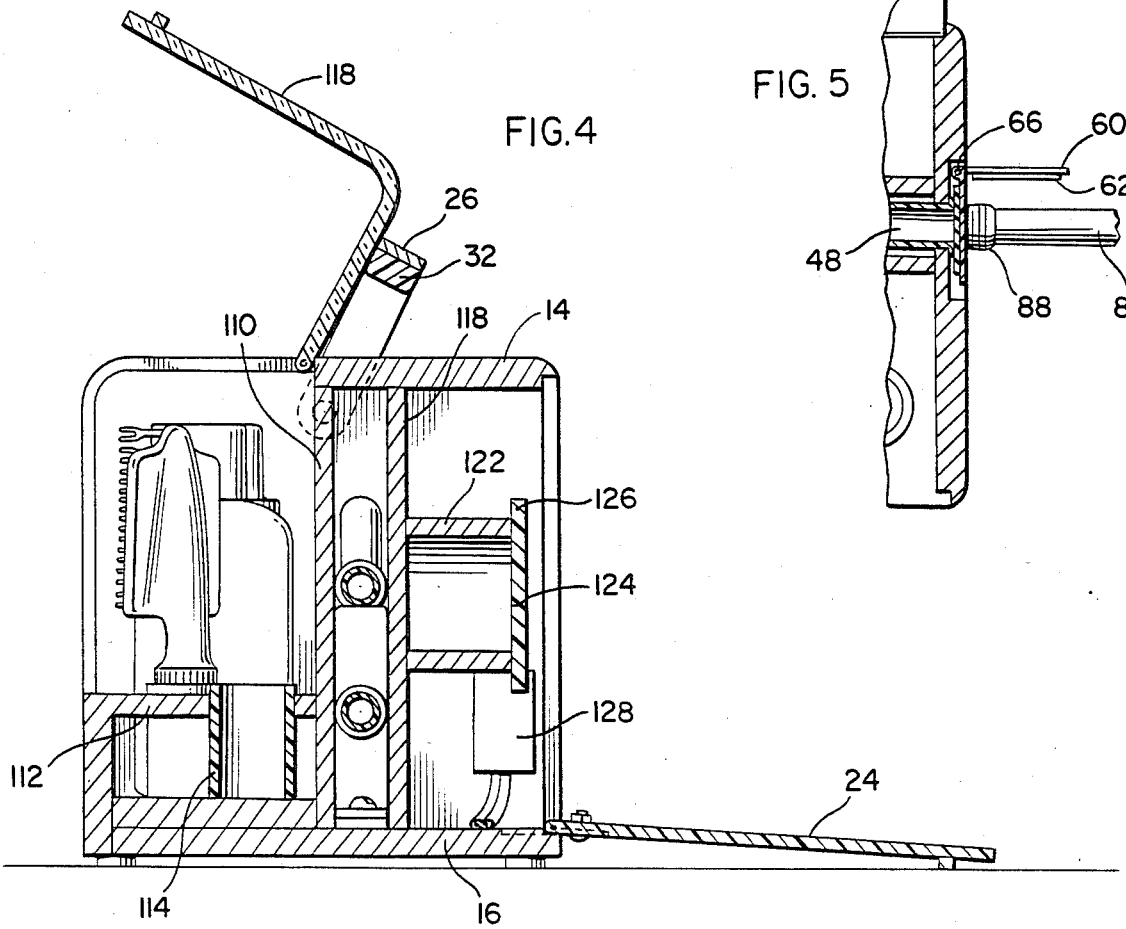
FIG. 4 is a transverse, sectional view of the invention.
Figure 5:
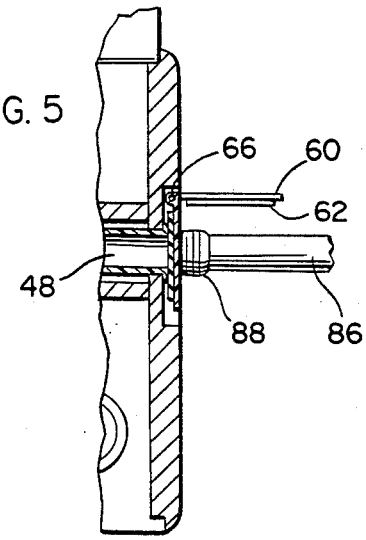
FIG. 5 is a fragmental sectional view taken along section line 5—5 on FIG. 3 illustrating the structure of the receptacle for connecting the flexible hose with the vacuum system.

The front wall 22 of the housing 12 includes a large recess 108 defined by a longitudinal partition wall 110 and a horizontal partition wall 112 spaced above the bottom wall 16 as illustrated in FIG. 4 with a plurality of tubular sockets 114 extending downwardly through the horizontal partition wall 112 for telescopically receiving the applicances 92, 94 and 96 for storage and also receiving containers or the like such as an aerosol container of insecticide or deodorizer indicated by numeral 116. An L-shaped closure door 118 is pivoted to the upper inner edge portion of the recess 108 so that it can swing from a closed position to an open position as illustrated in FIGS. 1 and 4 to provide access to the appliances and containers stored in the recess 108.

A second longitudinal partition 118 parallels partition 110 in spaced relation thereto to provide a space for the conduits 48 and 50 as well as the housing 74 with the grid 72 therein. The partition 118 forms an inner wall for a storage compartment 120 closed by the pivotal rear wall 24. The storage compartment 120 includes a projection 122 of hollow construction and generally oval-shaped in configuration with a closure plate 124 at the outer end thereof with the closure plate including a flange 126 extending peripherally beyond the projection 122. This provides a storage reel for the hose 86 and the electrical cord having the plug 54 thereon which is connected to a junction box 128 located on partition wall 34 with the cord being normally stored in the compartment 120 and either the edge of the end wall 18 or the edge of the rear wall 24 may be provided with a notch to receive the cord so that the rear wall 24 can be in closed position when the cord is extended and inserted into a conventional electrical outlet.

In use, when the vacuum hose 86 is in the upper receptacle 58, the flow path is straight through the conduit 48 into the disposable bag 46. This is the grooming mode in which either the appliance 94 or 96 is used for grooming, removing loose hair, dirt, dandruff and the like with such material going through the vacuum tube 48 into the disposable paper vacuum bag 46. The door 70 on the lower receptacle 68 will be closed and the vacuum induced in the vacuum tube 50 will retain the door 70 in closed and sealed position so that the unused port or receptacle is sealed so there is no vacuum leak.

When the flea removing appliance 92 is used on the hose 86, the hose is connected to the lower receptacle 68 so that the flow path is through the conduit 50 and through the housing 74 and past the grid 72. When fleas pass through the grid 72, they are electrocuted and the dead fleas are vacuumed into the disposable bag 46. The nozzle 98 on the appliance 92 is sufficiently small to prevent large amounts of hair or other foreign objects from entering the electric grid apparatus. The electric grid is significant since it kills the fleas to prevent any live fleas from entering the disposable bag only to escape later when the vacuum unit is turned off. The large door in the rear provides access to the power cord, vacuum hose and disposable vacuum cleaner-type bag and the door is retained releasably in closed position in any suitable manner and by providing any suitable fastening arrangements. The front door provides storage and easy location and access to the flea nozzle and grooming implements as well as grooming spray, deodorizer or other desired materials. Everything that is necessary to groom a small animal is contained in the unit with the carrying handle providing easy mobility and most components are constructed of plastic material. The device is especially useful to pet owners who do not have access to an open outdoor grooming area and enables pet owners who may be allergic to hair, dandruff, pesticides and the likes to groom an animal without coming into contact with such materials.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for treating a pet by inducing a vacuum in an appliance for contact engagement with the hair or fur of a pet comprising a housing having a vacuum system incorporated therein including a disposable vacuum cleaner-type bag with the bag having an inlet communicating with vacuum tube means extending from the bag to a peripheral wall of the housing with the vacuum tube means being connected to a receptacle means exposed to the exterior of the housing, an elongated vacuum hose of flexible construction having one end insertable into the receptacle means and an appliance on the other end of the vacuum hose with said appliance including means engaging the hair and fur of a pet for inducing a vacuum in the area of engagement between the appliance and hair or fur of the pet, said vacuum tube means including a pair of vacuum tubes with one of the tubes being substantially straight and uninterrupted and the other of the tubes including a hollow grid housing incorporated therein forming part of the flow path with an electrically charged grid in the grid housing for electrocuting fleas or other insects passing therethrough, 2. The structure as defined in claim 1 wherein said receptacle means includes a receptacle communicating with the uninterrupted vacuum tube and a separate receptacle communicating with the vacuum tube having the hollow grid housing incorporated therein, each of said receptacles including a closure door with a gasket engaging an open end of the receptacle for retaining the doors in closed position by a vacuum induced in the vacuum tubes.

3. The structure as defined in claim 2 wherein said hose includes a tapered adapter on each end thereof with one of the adapters telescopically, frictionally and sealingly received in a selected receptacle.

4. The structure as defined in claim 3 wherein said appliance includes a tubular member telescopically, frictionally and sealingly engaged with the adapter remote from the receptacle with the two adapters being identical to enable either end of the hose to be connected to the receptacle.

5. The structure as defined in claim 4 together with a plurality of appliances, one of said appliances including a nozzle of reduced cross-sectional area for mounting on the hose when the hose is connected to the vacuum tube having the hollow grid housing therein with the reduction in cross-sectional area of the nozzle providing a high velocity air intake for entraining fleas into the vacuum hose for passing through the hollow grid housing and electrocution of the fleas by passing over the grid.

6. The structure as defined in claim 5 together with an independent switch and indicator light electrically connected with the grid for manual actuation when removing fleas thereby energizing the grid only when fleas are being removed with the flea removing nozzle.

7. The structure as defined in claim 4 wherein said appliance includes a hollow housing with a plurality of laterally projecting teeth forming a grooming comb, said hose being connected to the receptacle communicated with the uninterrupted vacuum tube when using the grooming comb.

8. The structure as defined in claim 4 wherein said appliance includes a hollow brush head with a plurality of laterally extending bristle-type members forming a grooming brush with the grooming brush appliance being used when the hose is connected to the receptacle communicated with the uninterrupted vacuum tube.

9. The structure as defined in claim 4 wherein said housing includes a first storage compartment in one wall for a plurality of interchangeable appliances for connection with the vacuum hose, said first storage compartment also receiving grooming supplies and a pivotal closure forming a closure for the first storage compartment.

10. The structure as defined in claim 9 wherein said housing includes a second storage compartment in another wall for the vacuum hose when separated from the receptacles, said second storage compartment including a stationary reel on which the hose can be stored and a closure door for the second storage compartment, said housing having an external configuration in the form of a generally rectangular parallelpiped, and a centrally located handle extending longitudinally along the top of the housing and connected to the housing to facilitate carrying.

11. An apparatus for removing and exterminating fleas, flea eggs and other insects which may occupy the hair or fur of an animal comprising a housing having a vacuum system incorporated therein including a disposable vacuum cleaner-type bag with the bag having an inlet communicating with vacuum tube means extending from the bag to a peripheral wall of the housing, said vacuum tube means being connected to a receptacle means exposed to the exterior of the housing, an elongated vacuum hose of flexible construction having one end insertable into the receptacle means and an appliance on the other end of the vacuum hose with said appliance including inlet means for engaging the hair and fur of an animal for inducing a vacuum in the area of engagement between the appliance and hair or fur of the animal, said vacuum tube means including passageway means establishing a flow path from the receptacle means to said bag, and means in said passageway means for electrocuting fleas or other insects passing through the flow path to said bag whereby the killed fleas, flea eggs and other insects will be collected in the bag.

* * * * *